US007107910B2

(12) United States Patent
Hunn et al.

(10) Patent No.: US 7,107,910 B2
(45) **Date of Patent: *Sep. 19, 2006**

(54) PENETRATOR AND METHOD OF USING SAME

(75) Inventors: David L. Hunn, Kennedale, TX (US); Johnny E. Banks, Venus, TX (US); Carlton B. Cowan, Benbrook, TX (US)

(73) Assignee: Lockheed Martin Corp., Grand Prairie, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/988,125

(22) Filed: Nov. 12, 2004

(65) Prior Publication Data

US 2005/0257713 A1 Nov. 24, 2005

Related U.S. Application Data

(62) Division of application No. 10/251,468, filed on Sep. 20, 2002, now Pat. No. 6,843,179.

(51) Int. Cl.
*F42B 12/06* (2006.01)

(52) U.S. Cl. ..... 102/519; 244/3.24

(58) Field of Classification Search ..... 102/517, 102/518, 519; 244/3.3, 3.24
See application file for complete search history.

(56) References Cited

U.S. PATENT DOCUMENTS

| | | | | |
|---|---|---|---|---|
| 4,546,940 | A * | 10/1985 | Andersson et al. | 244/3.29 |
| 4,864,934 | A * | 9/1989 | Theising | 102/430 |
| 5,139,216 | A * | 8/1992 | Larkin | 244/3.21 |
| 5,183,960 | A * | 2/1993 | Shires | 102/348 |
| 6,843,179 | B1 * | 1/2005 | Hunn et al. | 102/519 |

* cited by examiner

*Primary Examiner*—Stephen M. Johnson
(74) *Attorney, Agent, or Firm*—Daren C. Davis; James E. Walton

(57) ABSTRACT

A penetrator includes a fore body comprising a pin and having a center of aerodynamic pressure forward of a center of gravity and a stabilizing portion comprising a material of lower density than that of the fore body and a plurality of outwardly extending fins for improving an aerodynamic stability of the projectile and defining a bore in which the pin is received for removably attaching the fore body thereto such that, when attached to the fore body, a center of gravity for the penetrator is forward of a center of aerodynamic pressure for the penetrator.

19 Claims, 13 Drawing Sheets

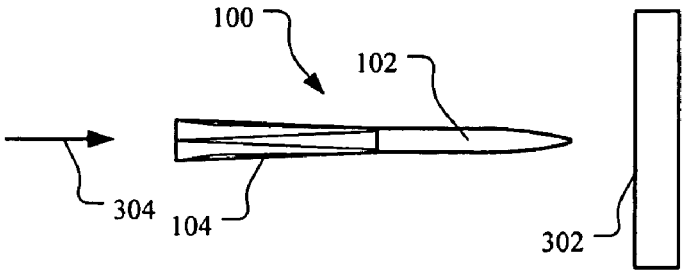
FIG. 3A
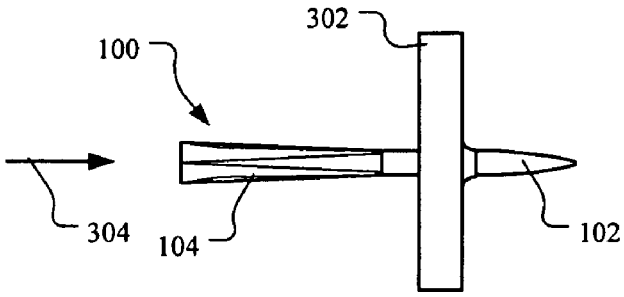
FIG. 3B
FIG. 3C
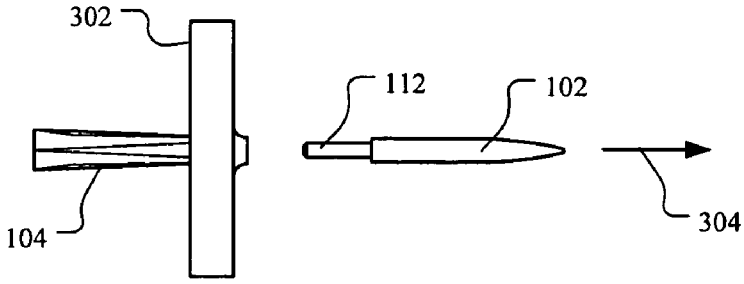
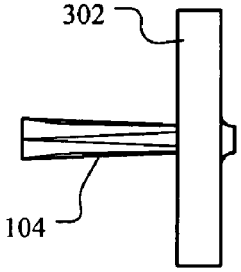
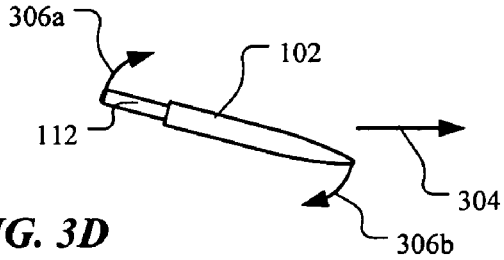
FIG. 3D

PENETRATOR AND METHOD OF USING SAME

CROSS-REFERENCE TO RELATED APPLICATIONS

This application is related to application Ser. No. 10/251,423 now abandoned, entitled "A Penetrator and Method of Using Same" by inventors Hunn, Banks, and Cowan, filed on Sept. 20, 2002. The present application is a divisional of co-pending application Ser. No. 10/251,468, filed Sep. 20, 2002 now U.S. Pat. No. 6,843,179.

BACKGROUND OF THE INVENTION

1. Field of the Invention

This invention relates to a penetrator and a method of using the penetrator, and, more particularly, to a penetrator for penetrating and damaging a variety of different types of targets.

2. Description of the Related Art

Flechettes generally are small, dart-like, projectiles that are typically dispensed at high velocities and in large numbers to damage various types of targets. As they are unpowered and have no explosive elements, they rely on kinetic energy as the damage mechanism. They are generally designed to have minimum aerodynamic drag so that they can travel over long distances at high velocities with good accuracy. Flechettes may be individually dispensed from a gun, dispensed in numbers from a gun in a shotgun-like manner, or dispensed in numbers from a warhead of a rocket or missile.

Flechettes are typically designed with the intended target in mind. For example, some flechettes are designed to behave as hardened penetrators to breach harder targets, such as thin armor. Such flechettes are less effective against softer targets because they tend to pass through the target quickly with minimal damage. Other flechettes are designed to damage softer targets by fracturing or bending as they strike the target; however, they are often ineffective against harder targets because of the tendency to fracture or bend upon striking such targets.

In combat situations wherein both harder and softer targets are anticipated, flechettes for each type of target have conventionally been needed. Supplying, storing, and deploying multiple types of flechettes based upon the perceived or anticipated target may lead to logistical difficulties. Other conventional approaches to damaging both harder and softer targets have included the use of other types of penetrators, often having explosive components, which are more expensive to deploy than flechette-based weapons.

The present invention is directed to overcoming, or at least reducing, the effects of one or more of the problems set forth above.

SUMMARY OF THE INVENTION

In one aspect of the present invention, a penetrator is provided. The penetrator includes a fore body comprising a pin and having a center of aerodynamic pressure forward of a center of gravity and a stabilizing portion comprising a material of lower density than that of the fore body and a plurality of outwardly extending fins for improving an aerodynamic stability of the projectile and defining a bore in which the pin is received for removably attaching the fore body thereto such that, when attached to the fore body, a center of gravity for the penetrator is forward of a center of aerodynamic pressure for the penetrator.

In another aspect of the present invention, a penetrator is provided. The penetrator includes a fore body comprising a material selected from the group consisting of tungsten, a tungsten alloy, an iron alloy, and steel and a pin, the fore body having a center of aerodynamic pressure forward of a center of gravity and a stabilizing portion comprising a material selected from the group consisting of a polymeric material, aluminum, an aluminum alloy, magnesium, and a magnesium alloy and a plurality of outwardly extending fins for improving an aerodynamic stability of the projectile and defining a bore in which the pin is received for removably attaching the fore body thereto such that, when attached to the fore body, a center of gravity for the penetrator is forward of a center of aerodynamic pressure for the penetrator.

In yet another aspect of the present invention, a vehicle capable of flight is provided. The vehicle includes a body, means for propelling the vehicle, and a plurality of penetrators disposed within the body and dispensable therefrom. At least one of the plurality of penetrators includes a fore body comprising a pin and having a center of aerodynamic pressure forward of a center of gravity and a stabilizing portion comprising a material of lower density than that of the fore body and a plurality of outwardly extending fins for improving an aerodynamic stability of the projectile and defining a bore in which the pin is received for removably attaching the fore body thereto such that, when attached to the fore body, a center of gravity for the penetrator is forward of a center of aerodynamic pressure for the penetrator.

In another aspect of the present invention, a vehicle capable of flight is provided. The vehicle includes a body, means for propelling the vehicle, and a plurality of penetrators disposed within the body and dispensable therefrom. At least one of the plurality of penetrators comprises a fore body comprising a material selected from the group consisting of tungsten, a tungsten alloy, an iron alloy, and steel and a pin, the fore body having a center of aerodynamic pressure forward of a center of gravity and a stabilizing portion comprising a material selected from the group consisting of a polymeric material, aluminum, an aluminum alloy, magnesium, and a magnesium alloy and a plurality of outwardly extending fins for improving an aerodynamic stability of the projectile and defining a bore in which the pin is received for removably attaching the fore body thereto such that, when attached to the fore body, a center of gravity for the penetrator is forward of a center of aerodynamic pressure for the penetrator.

In yet another aspect of the present invention, a cartridge is provided. The cartridge includes a casing, an explosive charge disposed within the casing, a primer proximate the explosive charge, and at least one penetrator disposed within the casing forward of the explosive charge. The at least one penetrator includes a fore body comprising a pin and having a center of aerodynamic pressure forward of a center of gravity and a stabilizing portion comprising a material of lower density than that of the fore body and a plurality of outwardly extending fins for improving an aerodynamic stability of the projectile and defining a bore in which the pin is received for removably attaching the fore body thereto such that, when attached to the fore body, a center of gravity for the penetrator is forward of a center of aerodynamic pressure for the penetrator.

In another aspect of the present invention, a cartridge is provided. The cartridge includes a casing, an explosive charge disposed within the casing, a primer proximate the explosive charge, and at least one penetrator disposed within the casing forward of the explosive charge. The at least one penetrator includes a fore body comprising a material selected from the group consisting of tungsten, a tungsten alloy, an iron alloy, and steel and a pin, the fore body having a center of aerodynamic pressure forward of a center of gravity and a stabilizing portion comprising a material selected from the group consisting of a polymeric material, aluminum, an aluminum alloy, magnesium, and a magnesium alloy and a plurality of outwardly extending fins for improving an aerodynamic stability of the projectile and defining a bore in which the pin is received for removably attaching the fore body thereto such that, when attached to the fore body, a center of gravity for the penetrator is forward of a center of aerodynamic pressure for the penetrator.

In yet another aspect of the present invention, a method of using a penetrator is provided. The method includes propelling the penetrator toward a first target, penetrating the first target with a fore body of the penetrator, detaching a stabilizing portion of the penetrator from the fore body, skewing a spatial orientation of the fore body after the stabilizing portion is detached from the fore body, and impacting the second target with the fore body.

In another aspect of the present invention, a method of using a penetrator is provided. The method includes propelling the penetrator toward a first target, penetrating the first target with a fore body of the penetrator, detaching a stabilizing portion of the penetrator from the fore body, penetrating an intermediate target with the fore body, skewing a spatial orientation of the fore body after penetrating the intermediate target, and impacting the second target with the fore body.

In yet another aspect of the present invention, a method of using a penetrator is provided. The method includes propelling the penetrator toward a first target, penetrating the first target with a fore body of the penetrator, detaching a stabilizing portion of the penetrator from the fore body, penetrating an intermediate target with the fore body, impacting the second target with the fore body, and skewing a spatial orientation of the fore body as it travels through the second target.

BRIEF DESCRIPTION OF THE DRAWINGS

The invention may be understood by reference to the following description taken in conjunction with the accompanying drawings, in which the leftmost significant digit(s) in the reference numerals denote(s) the first figure in which the respective reference numerals appear, and in which:

FIGS. 3A–3L are stylized diagrams illustrating a use of the penetrator of FIGS. 1–3 according to the present invention;

Figure 1A:
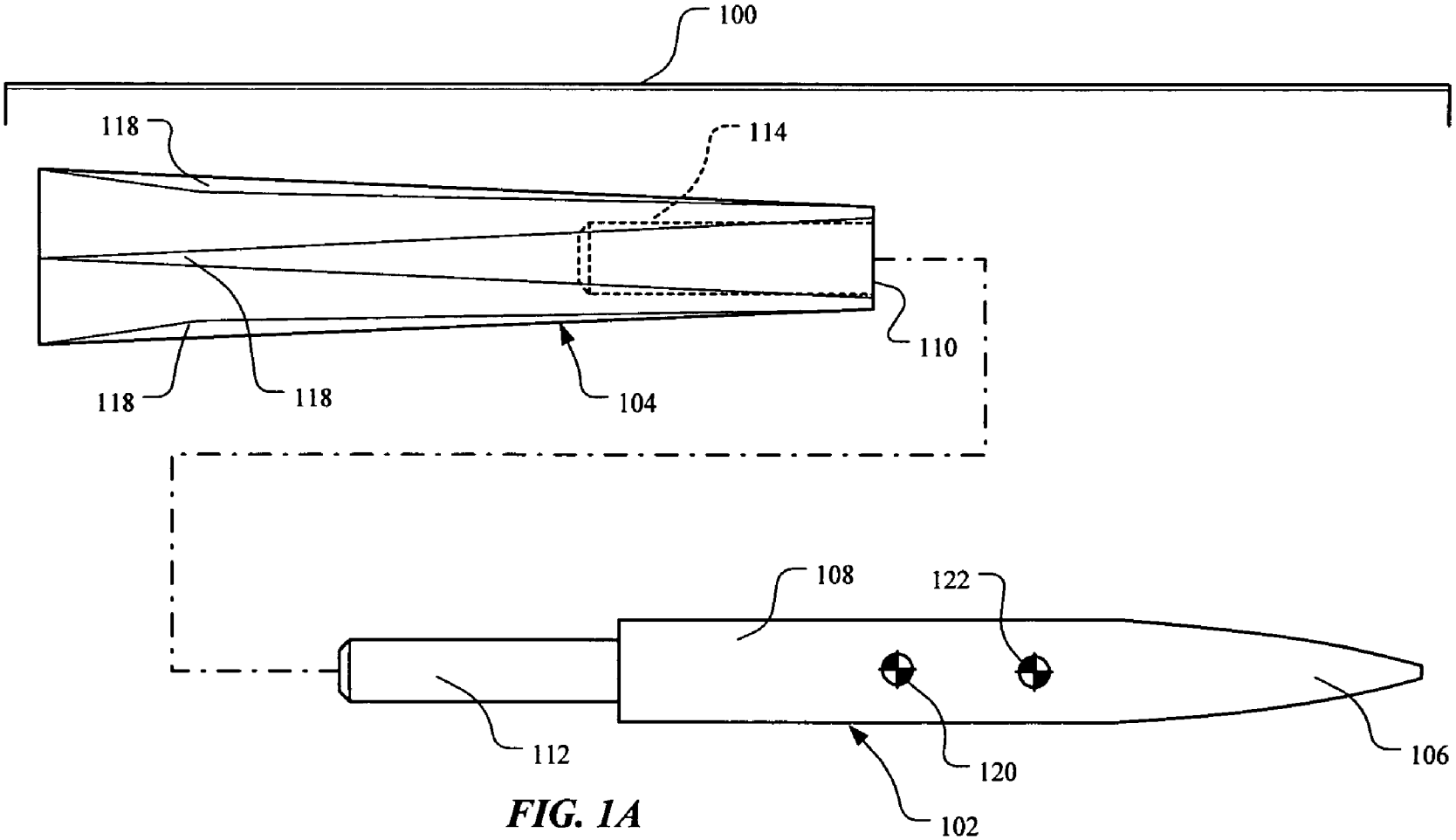
FIG. 1A is an exploded side view of a penetrator according to the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

FIG. 1A provides an exploded view of an illustrative embodiment of the present invention. A penetrator 100 includes a fore body 102 coupled with a stabilizing portion 104. In the illustrated embodiment, the fore body 102 comprises a nose portion 106 shaped to decrease aerodynamic drag on the penetrator 100 when assembled with the stabilizing portion 104 and to augment the hard target piercing capability of the penetrator 100. However, the invention is not so limited. Rather, the fore body 102 in general, and the nose portion 106 in particular, may have any chosen shape. Thus, by way of example and illustration, the fore body 102 is but one means for penetrating the target 302. Moving aftward along the fore body 102, the nose portion 106 transitions to a body portion 108, which has an outer diameter generally corresponding to that of a forward end 110 of the stabilizing portion 104 to decrease aerodynamic drag on the penetrator 100. However, the scope of the present invention is not so limited, but rather the body portion 108 and the forward end 110 of the stabilizing portion 104 may have any chosen dimensions and/or shapes.

Figure 2A:
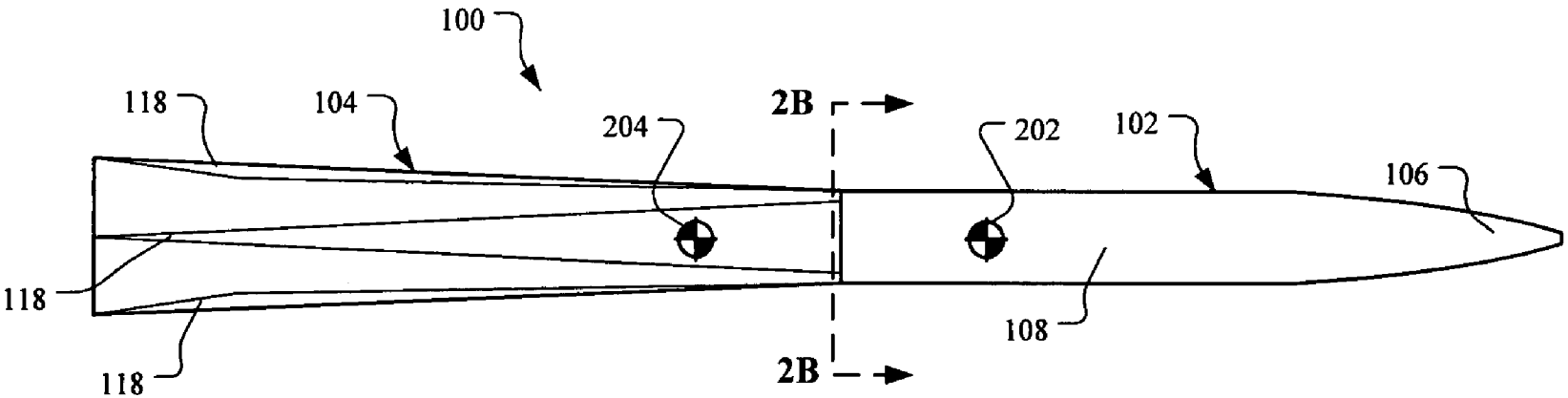
FIG. 2A is an assembled side view of the penetrator of FIGS. 1A and 1B.
Figure 2B:
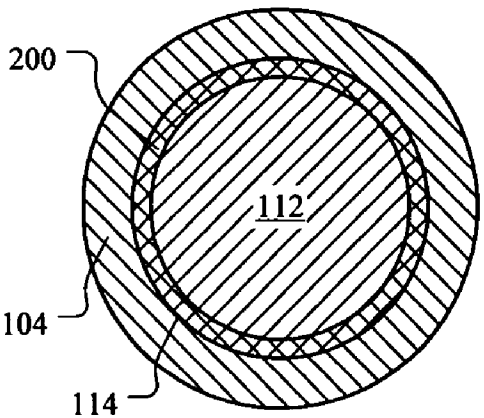
FIG. 2B is a cross-sectional view of the penetrator of FIG. 2 taken along the line 2B—2B.

In the illustrated embodiment, the fore body 102 further includes a pin 112 extending aftward from the body portion 108. When assembled, the pin 112 is received in a blind bore 114 defined by the stabilizing portion 104 to couple the fore body 102 and the stabilizing portion 104, as shown in FIG. 2A. In one embodiment, the pin 112 is adhesively bonded within the bore 114 by an adhesive layer 116, shown in FIG. 2B. Alternatively, the pin 112 may have a press-fit relationship with the bore 114 and, in such an embodiment, the adhesive layer 116 is omitted. The scope of the present invention, however, encompasses any means for coupling the fore body 102 and the stabilizing portion 104, so long as the stabilizing portion 104 may be detached from the penetrator 100 as it encounters a target, as will be described later.

For example, the pin 112 may be part of the stabilizing portion 104 and the fore body 102 may define the bore 114, in which the pin is received. Alternatively, the pin 112 may be a separate element and each of the fore body 102 and the stabilizing portion 104 may define a bore (e.g., the bore 114) therein. In such an embodiment, the pin 112 would be received in both of the bores. Alternatively, other mechanical elements and/or interconnections may be used to detachably couple the fore body 102 and the stabilizing portion 104, and such mechanical elements and/or interconnections are considered to be within the scope of the present invention.

Figure 1B:
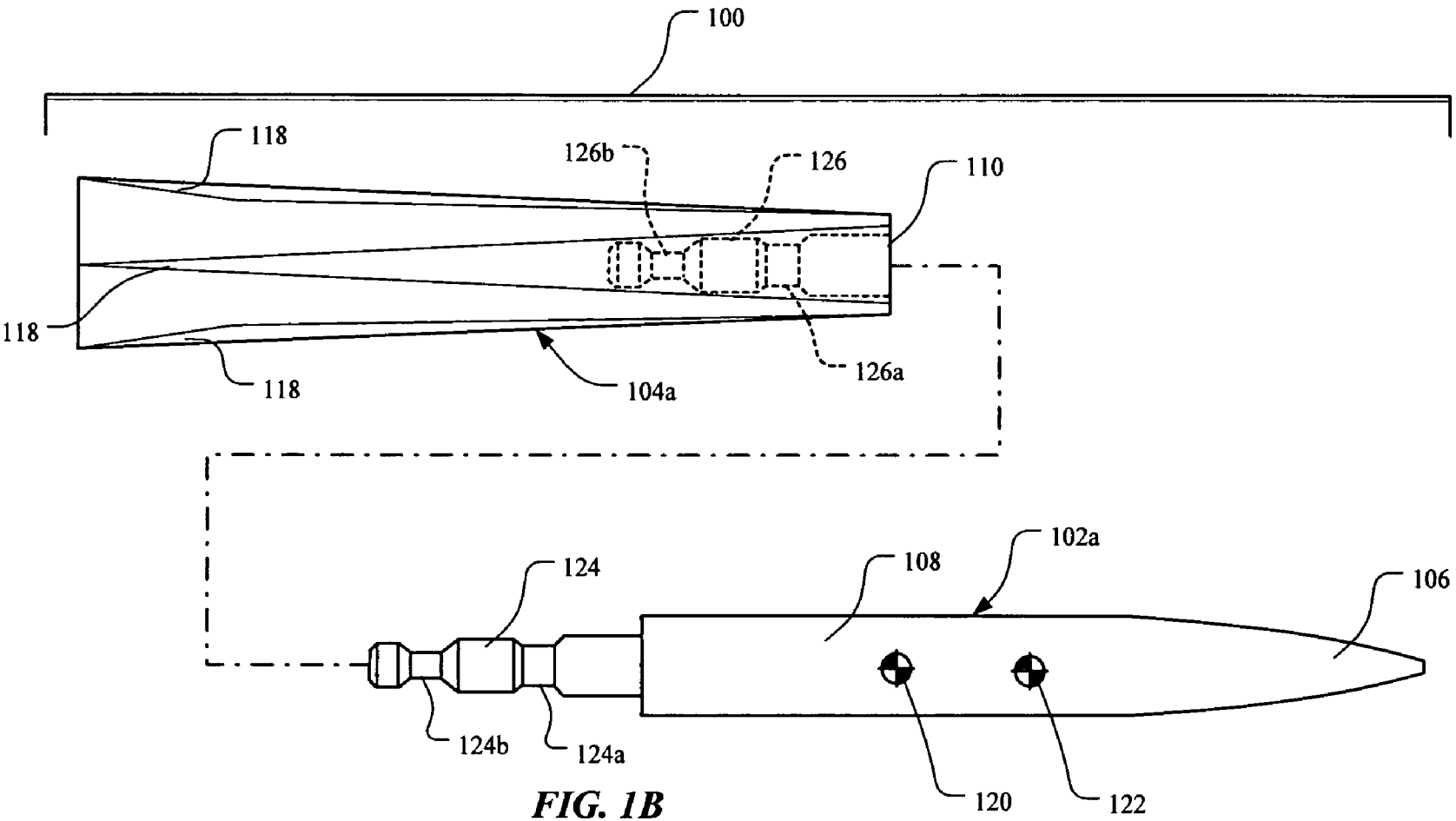
FIG. 1B is an exploded side view of the penetrator of FIG. 1A including an alternative pin and blind bore.

For example, as shown in FIG. 1B, an alternative fore body 102*a* includes a pin 124 (as an alternative to the pin 112 of FIG. 1A) extending aftward from the body portion 108. When assembled, the pin 124 is received in a blind bore 126 (as an alternative to the blind bore 114 of FIG. 1A) defined by an alternative stabilizing portion 104*a*. The pin 124 comprises grooves 124*a*, 124*b* that engage protrusions 126*a*, 126*b* of the blind bore 126 to detachably couple the fore body 102*a* with the stabilizing portion 104*a*. In one embodiment, the pin 124 and the blind bore 126 are sized and configured such that the pin 124 may be snapped into and out of the blind bore 126. Thus, by way of example and illustration, each of the pins 112, 124 is but one means for removably attaching the fore body 102*a* and the stabilizing portion 104*a*.

Referring again to FIGS. 1A and 1B, the stabilizing portion 104 provides aerodynamic stability to the penetrator 100 and, in one embodiment, comprises outwardly extending fins 118. While the illustrated embodiment includes the stabilizing portion 104 having three fins 116, the present invention is not so limited. Rather, the scope of the present invention includes a stabilizing portion (e.g., the stabilizing portion 104) having a plurality of fins of any chosen number. For example, an alternative embodiment of the present invention may include a stabilizing portion having four fins.

Figure 1C:
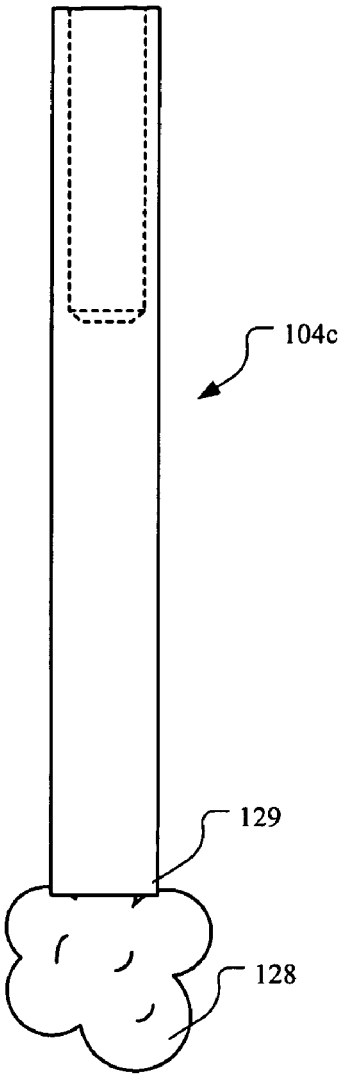
FIGS. 1C–1G are side views of stabilizing portions alternative to that of FIGS. 1A and 1B.
Figure 1D:
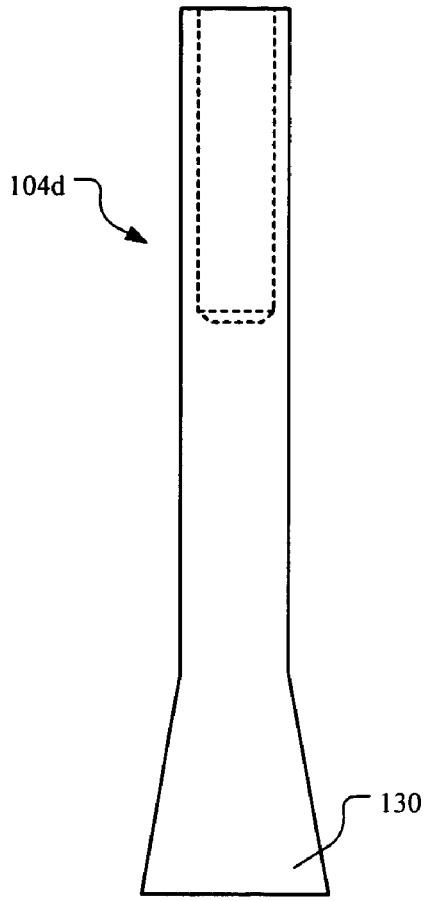
Figure 1E:
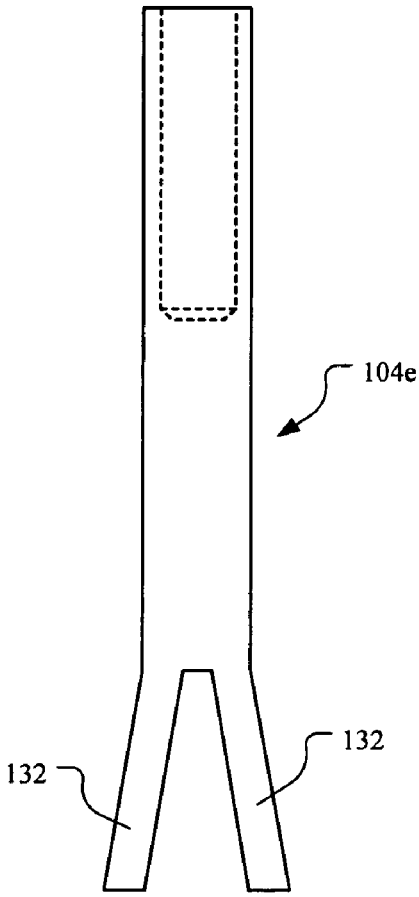

In fact, the scope of the present invention includes a stabilizing portion comprising any means for improving the aerodynamic stability of the penetrator 100. For example, as shown in FIG. 1C, a stabilizing portion 104*c* includes a tuft 128 disposed proximate an aft end 129 of the stabilizing portion 104*c*. In the illustrated embodiment, the tuft 128 may comprise a mass of randomly oriented fibers made of cotton, fiberglass, or the like. Further, as illustrated in FIG. 1D, a stabilizing portion 104*d* may comprise an outwardly sloping flare 130 for improving the aerodynamic stability of the penetrator 100. Alternatively, as shown in FIG. 1E, a stabilizing portion 104*e* may comprise a plurality of outwardly and aftwardly extending flaps 132 for improving the aerodynamic stability of the penetrator 100.

Figure 1F:
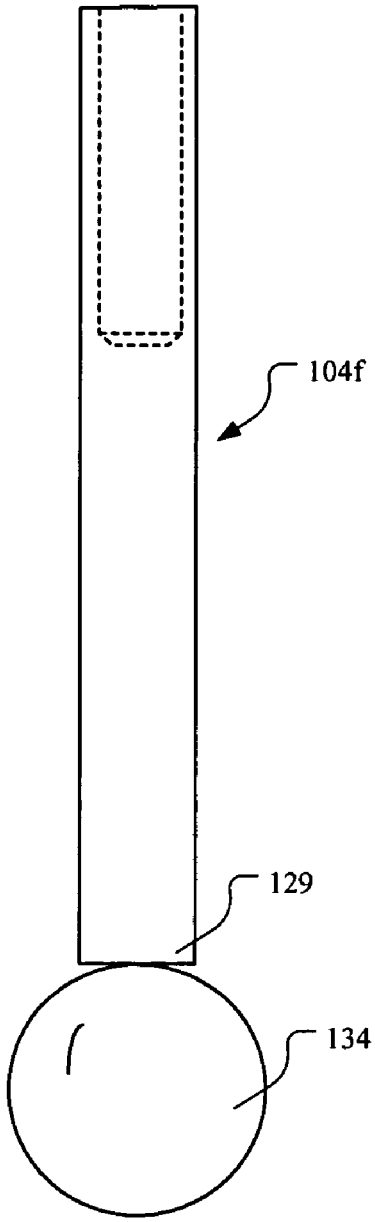

Further, as illustrated in FIG. 1F, a stabilizing portion 104*f* includes a balloon 134 disposed proximate an aft end 129 of the stabilizing portion 104*f* for improving the aerodynamic stability of the penetrator 100. The balloon 134 may be made of a rubber, nylon cloth, or any other chosen material capable of inhibiting a flow of air therethrough.

Figure 1G:
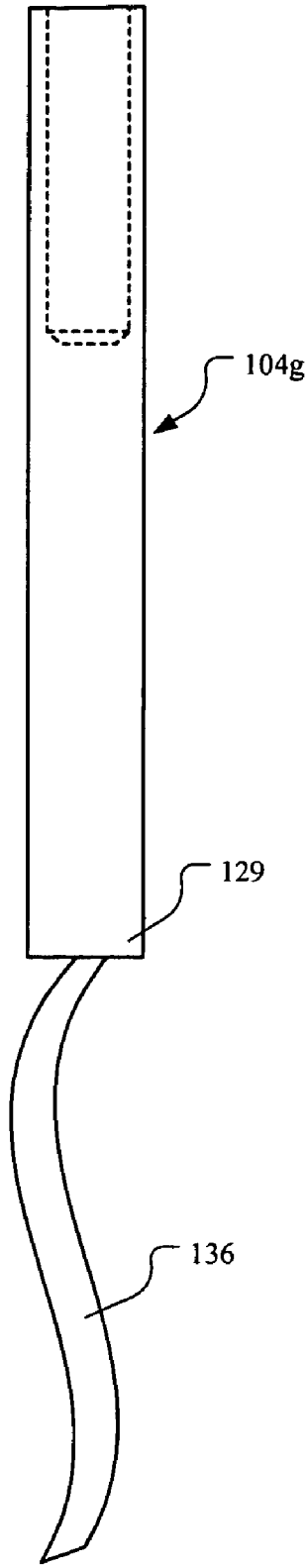

Alternatively, as shown in FIG. 1G, a stabilizing portion 104*g* includes a ribbon 136 disposed proximate an aft end 129 of the stabilizing portion 104*g* for improving the aerodynamic stability of the penetrator 100. The ribbon 136 may be made, for example, of fiberglass cloth, nylon cloth, or the like. Thus, by way of example and illustration, each of the stabilizing portions 104 and 104*a*–104*g* is but one means for aerodynamically stabilizing the penetrator 100. While the following description of the invention is provided relating to the stabilizing portion 104, the description applies equally to penetrators comprising any of the stabilizing portions 104*a*–104*g*.

In the illustrated embodiment, the fore body 102 comprises a material having a higher density than a material comprising the stabilizing portion 104. For example, in one embodiment, the fore body 102 may comprise tungsten, a tungsten alloy, an iron alloy, or steel, and the stabilizing portion 104 may comprise a polymeric material (e.g., an epoxy material or a urethane material), aluminum, an aluminum alloy, magnesium, or a magnesium alloy. The higher density material aids the fore body 102 in penetrating harder targets, such as armor plate, while the lower density material of the stabilizing portion 104 decreases the overall weight of the penetrator 100 and aids in achieving aerodynamic stability.

Generally, if a penetrator is to be aerodynamically stable, it is necessary for the center of gravity of the penetrator to be forward of the center of aerodynamic pressure of the penetrator. The "center of gravity" can be considered to be the point where all the weight of a penetrator can be considered to be concentrated. The "center of aerodynamic pressure" can be considered to be the point on a penetrator at which the total aerodynamic force effectively acts.

As indicated above, if the center of gravity of the penetrator is forward of the penetrator's center of aerodynamic pressure, the penetrator is considered to be aerodynamically stable. If, however, the center of gravity of the penetrator is aft of its center of aerodynamic pressure, the penetrator is considered to be unstable and will skew or tumble as it travels through a medium, such as air. Referring again to FIG. 2A, the center of gravity of the penetrator 100 is indicated generally at 202 and the center of aerodynamic pressure of the penetrator 100 is indicated generally at 204. With the center of gravity 202 being forward of the center of aerodynamic pressure 204, the penetrator 100 is considered to be aerodynamically stable. As will be appreciated by those skilled in the art having the benefit of this disclosure, the precise location of the center of gravity 202 and center of aerodynamic pressure 204 will be implementation specific, depending upon the overall design of the penetrator 100.

Figure 3E:
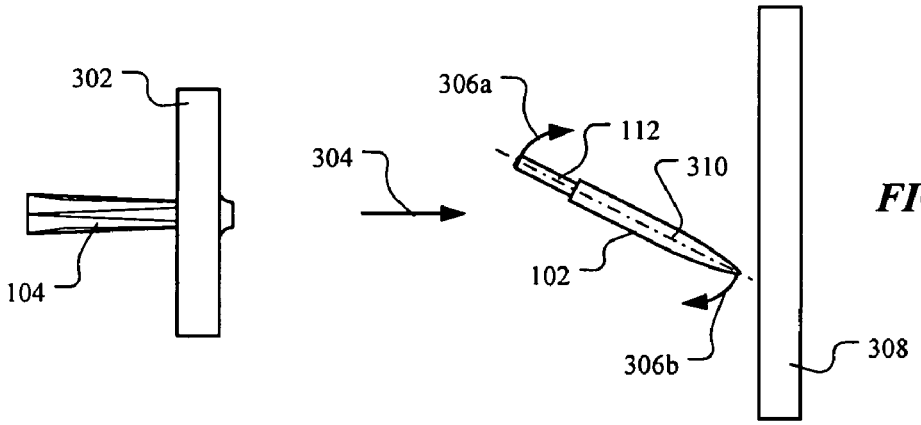

FIGS. 3A–3F illustrate the penetrator 100 in one particular use. FIG. 3A shows the penetrator 100 advancing toward (as indicated by an arrow 304) a first target 302. The first target is a "hard" target, such as an armor plate that might be used to protect a vehicle from combat damage. FIG. 3B illustrates the fore body 102 penetrating the first target 302.

As the penetrator 100 advances through the first target 302, the stabilizing portion 104 becomes wedged therein and separates from the fore body 102, as shown in FIG. 3C. In one embodiment, the adhesive layer 200 (shown in FIG. 2B) fractures as a result of the impact between the stabilizing portion 104 and the first target 302 to detach the stabilizing portion 104 from the fore body 102. In another embodiment, the pin 112 fractures as a result of the impact between the stabilizing portion 104 and the first target 302 to detach the stabilizing portion 104 from the fore body 102. In an embodiment wherein the fore body 102 comprises the pin 124 (as shown in FIG. 1B), the pin 124 is released from the blind bore 126 as a result of the impact between the stabilizing portion 104 and the first target 302. After separating from the stabilizing portion 104, the fore body 102 continues to travel beyond the first target 302.

However, as the stabilizing portion 104 is removed, the aerodynamic stability of the penetrator 100 changes. The spatial relationship between the center of gravity and the center of pressure of the fore body 102 is different than that for the fore body 102 and the stabilizing portion 104 together. Referring again to FIG. 1A, the center of gravity of the fore body 102 is indicated generally at 120 and the center of aerodynamic pressure of the fore body 102 is indicated generally at 122. As the center of aerodynamic pressure 122 is forward of the center of gravity 120, the fore body 102 is considered aerodynamically unstable. Upon removal of the stabilizing portion, the center of aerodynamic pressure 122 moves forward of the center of gravity 120 in a manner not shown, and the penetrator becomes aerodynamically unstable. Thus, the forward portion (i.e., the fore body 102) of the penetrator 100 begins to skew or tumble when the stabilizing portion 104 is removed.

Referring now to FIG. 3D, as the fore body 102 travels beyond the first target 302, it begins to skew or tumble from its previous spatial orientation (as indicated by arrows 306*a*, 306*b*) due to its aerodynamic instability. While FIG. 3D illustrates the fore body 102 tumbling in a clockwise direction, the fore body 102 may tumble in one or more directions in three-dimensional space over time as it travels through the air.

FIG. 3E illustrates the skewing or tumbling fore body 102 approaching a second target 308. The second target 308 is a "soft" target, such as the vehicle or equipment shielded by the first target 302 (e.g., the armor plate). As the fore body 102 skews or tumbles, it is likely that it will impact the second target 308 at an attitude other than in a "head-on" attitude, in which the nose portion 106 is forward and a central axis 310 of the fore body 102 is generally perpendicular to the second target 308. Thus, the fore body 102 in a non-head-on attitude impacts a larger area of the second target 308 than if the fore body 102 were in a head-on attitude, which will increase the amount of damage the fore body 102 may inflict on the second target 308.

Figure 3F:
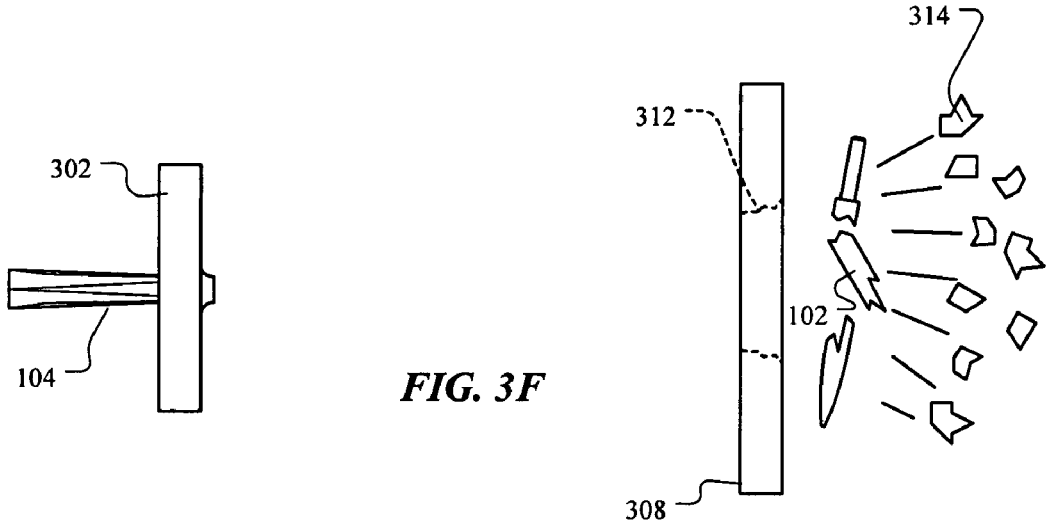

FIG. 3F illustrates the impact of the fore body 102 with the second target 308, producing an opening 312 therethrough and debris 314. Depending upon the construction of the second target 308 and the attitude at which the fore body 102 impacts the second target 308, the fore body 102 may break into a plurality of pieces, as shown in FIG. 3F, or may remain generally intact.

Figure 3G:
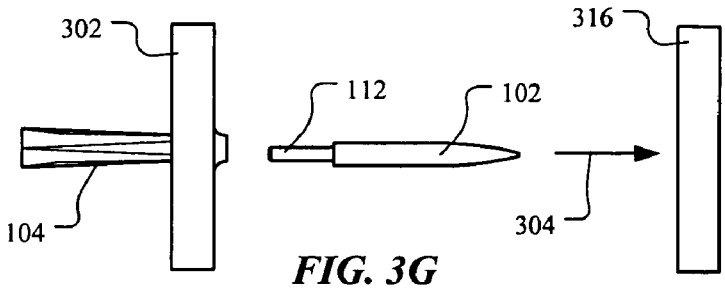

FIGS. 3G–3L illustrate the penetrator 100 in an alternative use, in which the fore body 102 additionally encounters an intermediate target 316 disposed between the first target 302 and the second target 308. The intermediate target 316 is a hard target, but is generally softer than the first target 302. In one embodiment, after the stabilizing portion 104 has separated from the fore body 102 (as shown in FIG. 3C), the fore body 102 travels toward the intermediate target 316 generally in an unskewed condition, as shown in FIG. 3G, or only marginally skewed. For example, the fore body 102 may not be skewed or may be only marginally skewed because the velocity of the fore body 102 may have been reduced, due to the impact with the first target, such that the fore body 102 is marginally aerodynamically stable. Further, the viscosity of the medium through which the fore body 102 is traveling may be insufficiently viscous to cause skewing thereof. Generally, a medium that is more viscous will induce more skewing or tumbling than a medium that is less viscous.

Figure 3H:
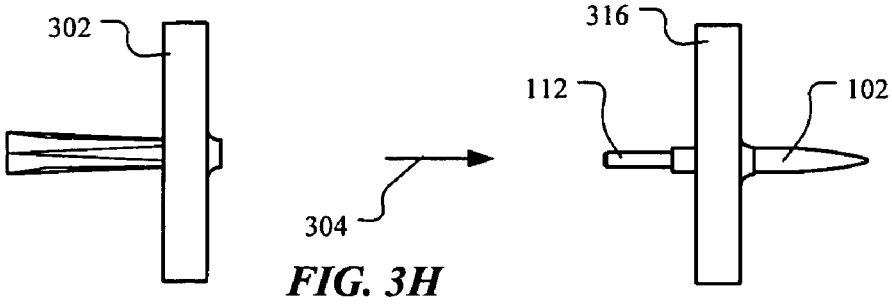
Figure 3I:
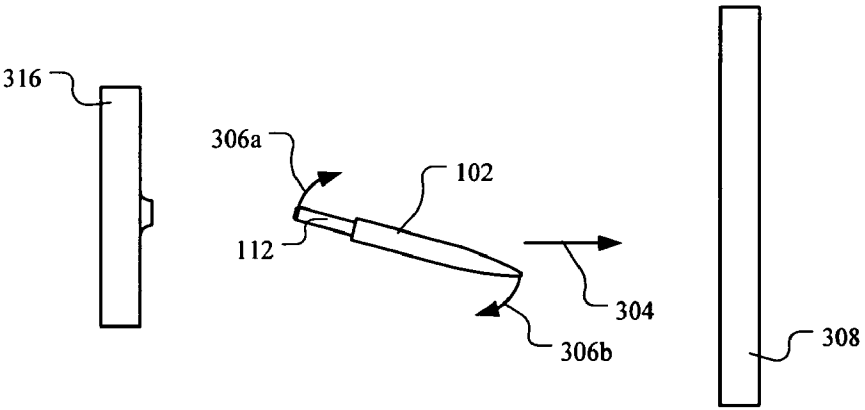
Figure 3J:
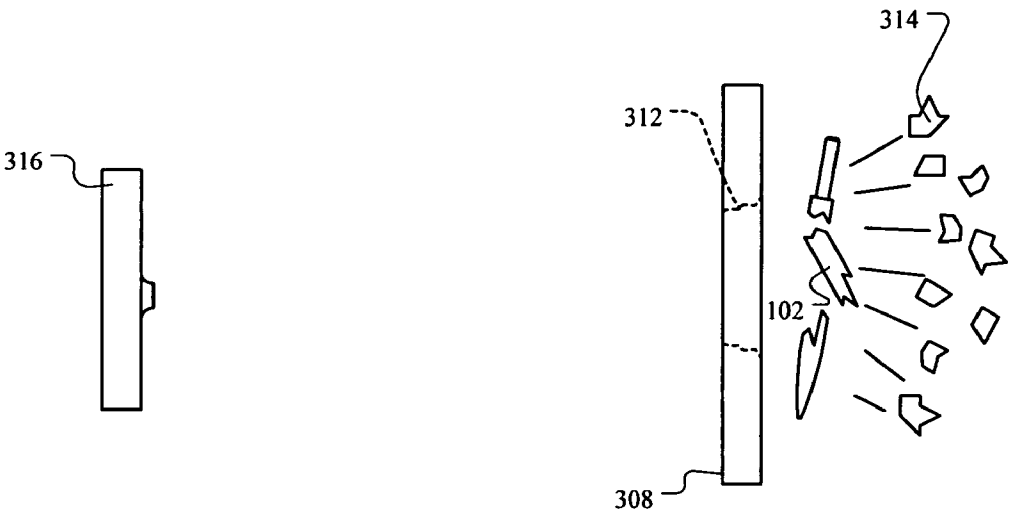

Thus, the fore body 102 encounters and penetrates the intermediate target 316 in generally a head-on attitude, as shown in FIG. 3H. In one embodiment, as shown in FIG. 31, the fore body 102 skews or tumbles, as described in reference to FIG. 3D, as it travels toward the second target 308. FIG. 3J illustrates the impact of the fore body 102 with the second target 308, producing the opening 312 therethrough and the debris 314. Depending upon the construction of the second target 308 and the attitude at which the fore body 102 impacts the second target 308, the fore body 102 may break into a plurality of pieces, as shown in FIG. 3J, or may remain generally intact.

Figure 3K:
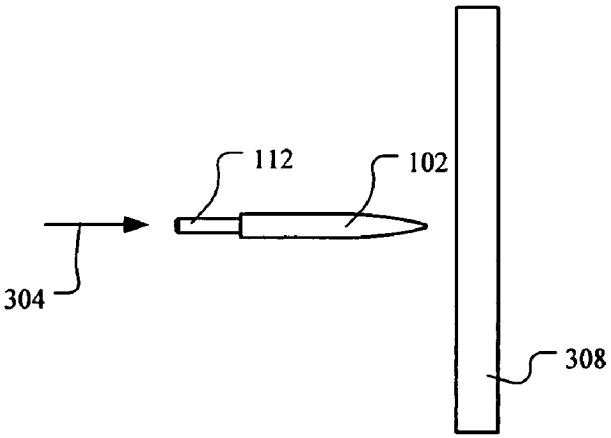
Figure 3K:
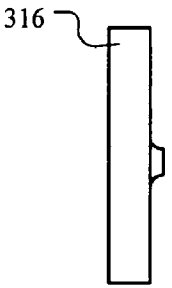
Figure 3K:
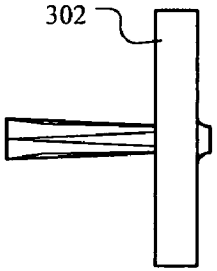
Figure 3L:
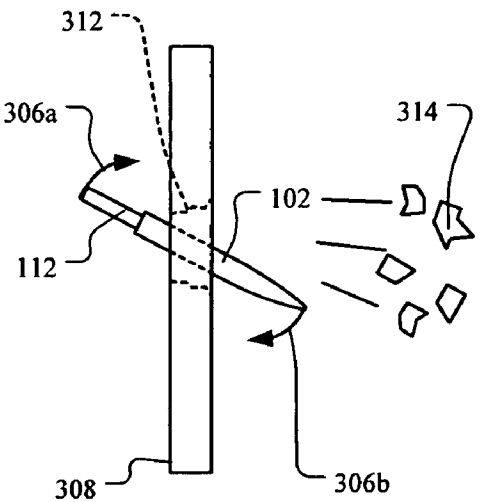
Figure 3L:
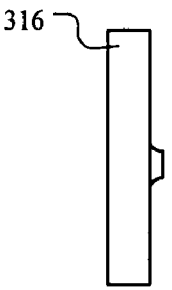
Figure 3L:
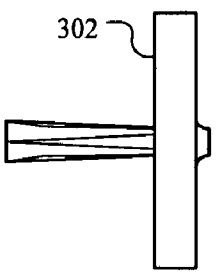

Alternatively, in one embodiment, the fore body 102 may remain generally unskewed or only marginally skewed after penetrating the intermediate target 316, as shown in FIG. 3K. The fore body 102 may remain generally unskewed or only marginally skewed as discussed above regarding FIG. 3G. As the fore body 102 impacts the second target 308, it skews or tumbles and penetrates the second target 308, as shown in FIG. 3L. The fore body 102 may become skewed or may tumble within the second target 308 as a result of an increased viscosity of the second target 308.

Figure 4A:
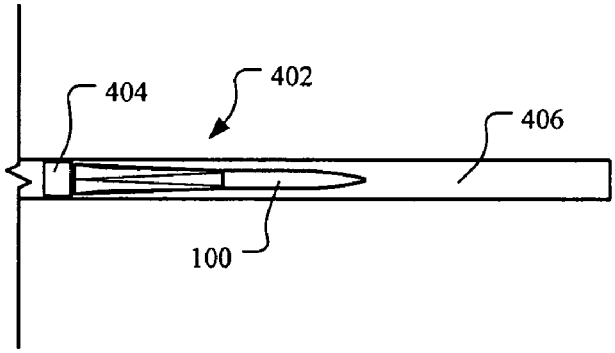
FIGS. 4A–4B are stylized diagrams illustrating propelling the penetrator of FIGS. 1–3 from a gun.
Figure 4B:
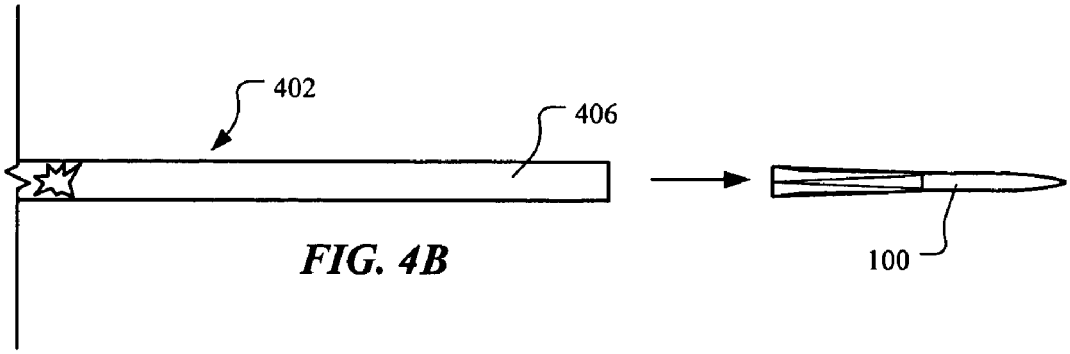

The penetrator 100 may be propelled or dispensed by any desired means. For example, as shown in FIGS. 4A and 4B, a gun 402 may be used to propel one or more of the penetrators 100. In the illustrated embodiment, an explosive charge 404 is disposed behind the penetrator 100 within the gun 402. Upon detonation of the explosive charge 404, the penetrator 100 is propelled through a barrel 406 of the gun and toward a target. The penetrator 100, however, may be propelled by any chosen means, such as by compressed air, a biasing member (e.g., a spring), or by other such methods.

Figure 5A:
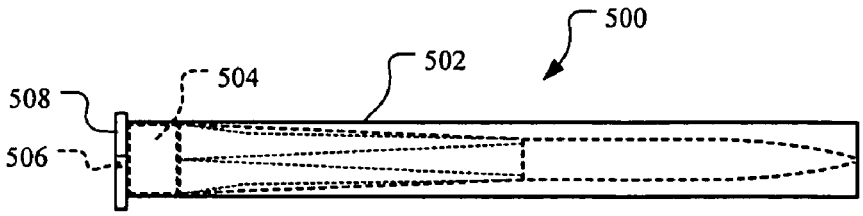
FIG. 5A is a stylized diagram of a cartridge including the penetrator of FIGS. 1–3.
Figure 5B:
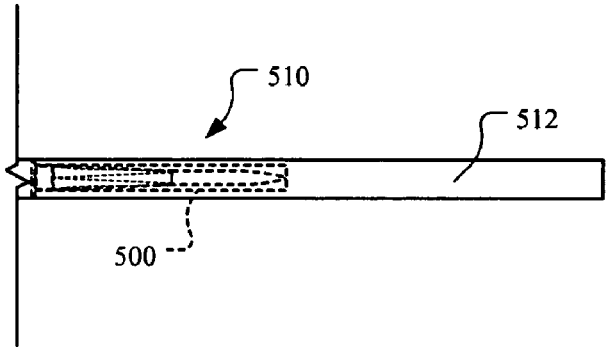
FIGS. 5B and 5C are stylized diagrams illustrating propelling the penetrator of FIGS. 1–3 from the cartridge of FIG. 5A disposed within a gun.
Figure 5C:
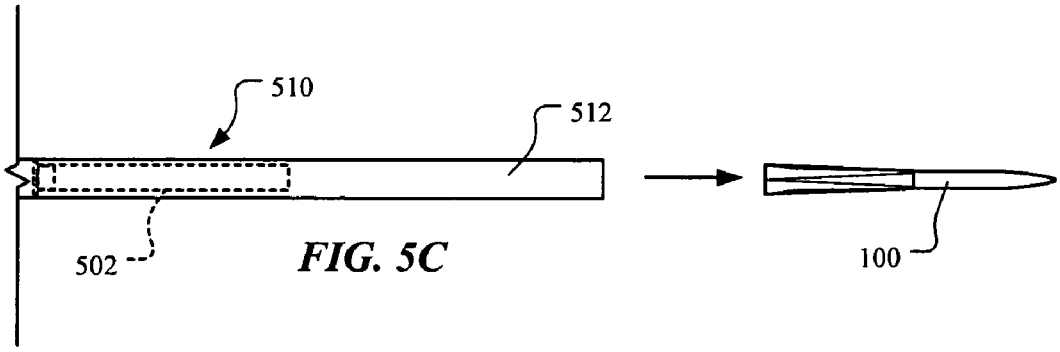

Alternatively, as shown in FIG. 5A, the penetrator 100 may form part of a cartridge 500. In such an embodiment, the cartridge 500 comprises a casing 502 for housing one or more penetrators 100 (only one penetrator 100 shown in FIG. 5) and an explosive charge 504, which is disposed behind the penetrator 100. In the illustrated embodiment, a primer 506 extends through a rear, end wall 508 of the cartridge and abuts the explosive charge 504. A firing mechanism (not shown) of a gun 510, shown in FIG. 5B, activates the primer 504, which, in turn, detonates the explosive charge 504. The propulsive energy created as a result of the detonation of the explosive charge 504 propels the penetrator 100 through a barrel 512 of the gun 510 and toward a target, as shown in FIG. 5C.

Figure 6A:
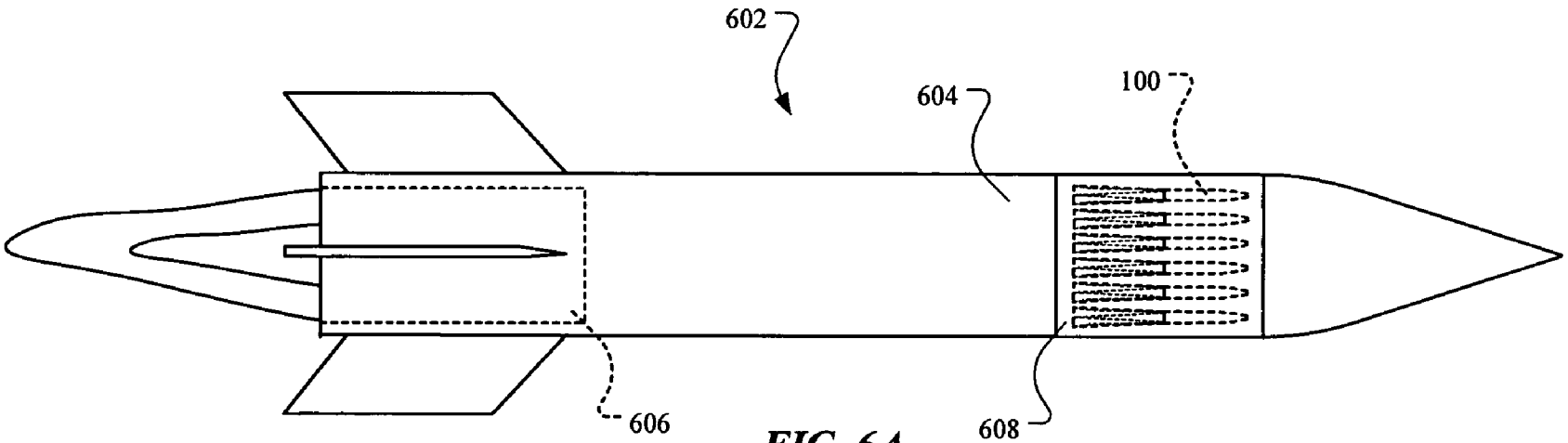
FIGS. 6A–6B are stylized diagrams illustrating dispensing a plurality of the penetrators of FIGS. 1–3 from an airborne vehicle.
Figure 6B:
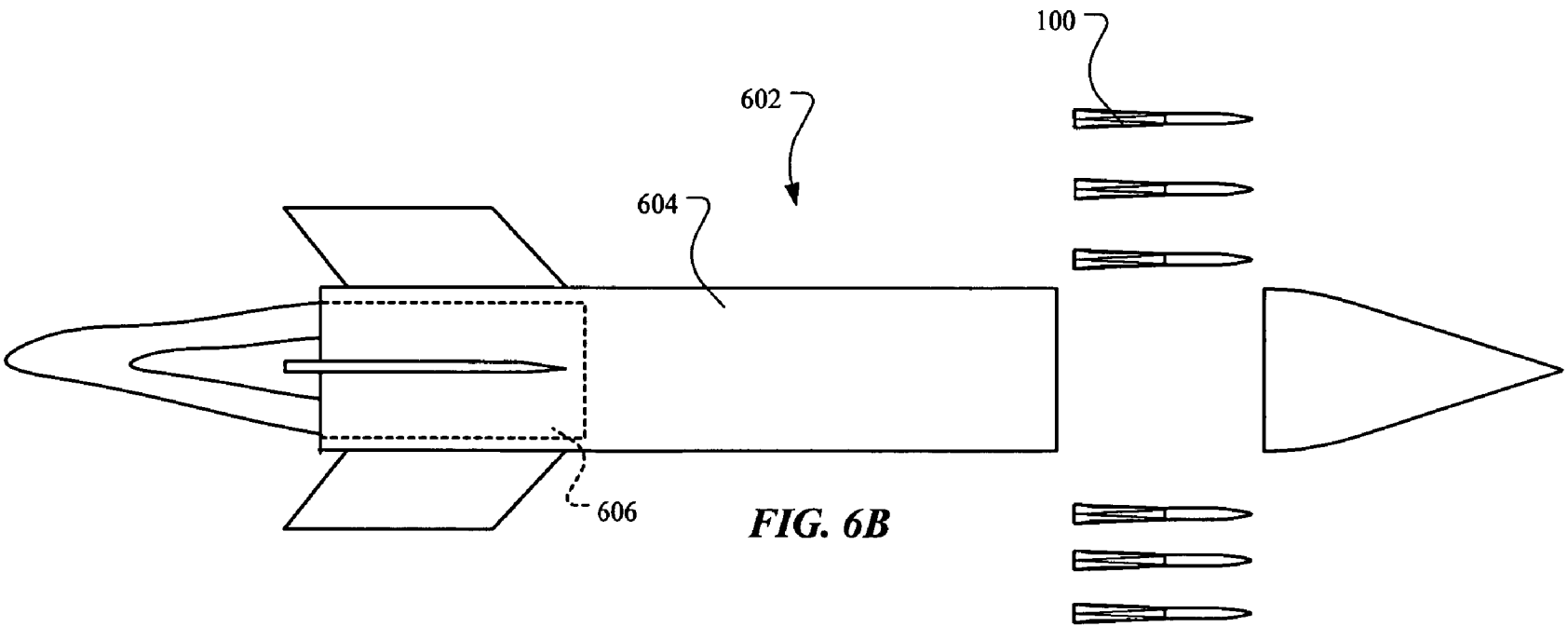

Further, one or more of the penetrators 100 may be dispensed by a vehicle capable of flight, such as a rocket, a missile, a bomb, or a projectile. In the embodiment illustrated in FIGS. 6A and 6B, the vehicle 602 comprises a body 604 and a means for propelling the vehicle 602, such as an engine or a motor 606. The penetrators 100 (only one indicated) are housed within the body 604, as shown in FIG. 6A, until such time as they are to be deployed. A portion 608 of the body 604 is ejected from the vehicle 602 to reveal the penetrators 100. The penetrators 100 are dispensed from the vehicle 602 as shown in FIG. 6B.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A penetrator, comprising:

a fore body having a center of aerodynamic pressure forward of a center of gravity;

a stabilizing portion removably attached to the fore body such that, when attached to the fore body, a center of gravity for the penetrator is forward of a center of aerodynamic pressure for the penetrator; and a pin removably attaching the fore body and the stabilizing portion.

2. A penetrator, according to claim 1, wherein at least one of the fore body and the stabilizing portion defines a bore in which the pin is retained.

3. A penetrator, according to claim 2, further comprising an adhesive layer for retaining the pin in the bore.

4. A penetrator, according to claim 2, wherein the pin is snapped into the bore.

5. A penetrator, according to claim 2, wherein the bore defines a protrusion and the pin defines a groove engaged with the protrusion.

6. A penetrator, according to claim 1, wherein the fore body defines the pin and the stabilizing portion defines a bore in which the pin is retained.

7. A penetrator, according to claim 6, further comprising an adhesive layer for retaining the pin in the bore.

8. A penetrator, according to claim 6, wherein the pin is snapped into the bore.

9. A penetrator, according to claim 6, wherein the bore defines a protrusion and the pin defines a groove engaged with the protrusion.

10. A penetrator, according to claim 1, wherein the stabilizing portion defines the pin and the fore body defines a bore in which the pin is retained.

11. A penetrator, according to claim 10, further comprising an adhesive layer for retaining the pin in the bore.

12. A penetrator, according to claim 10, wherein the pin is snapped into the bore.

13. A penetrator, according to claim 10, wherein the bore defines a protrusion and the pin defines a groove engaged with the protrusion.

14. A penetrator, according to claim 1, wherein the stabilizing portion comprises a plurality of outwardly extending fins for improving the aerodynamic stability of the penetrator.

15. A penetrator, according to claim 14, wherein the plurality of outwardly extending fins extend outwardly beyond an outside diameter of the fore body.

16. A penetrator, according to claim 1, wherein the stabilizing portion comprises one of an outwardly extending flare and a plurality of outwardly extending flaps for improving an aerodynamic stability of the penetrator.

17. A penetrator, according to claim 16, wherein the outwardly extending flare or the plurality of outwardly extending flaps extend outwardly beyond an outside diameter of the fore body.

18. A penetrator, according to claim 1, wherein the stabilizing portion further comprises one of a tuft, a balloon, and a ribbon disposed proximate an aft end of the stabilizing portion for improving an aerodynamic stability of the penetrator.

19. A penetrator, according to claim 1, wherein the stabilizing portion is adapted to be retained in a target.

* * * * *